US007063033B1

(12) United States Patent
Jackson

(10) Patent No.: US 7,063,033 B1
(45) Date of Patent: Jun. 20, 2006

(54) STACKABLE WATERCRAFT FLOAT SYSTEM

(76) Inventor: Jeffrey Jackson, 502 Club Dr., Prosperity, SC (US) 29127

( * ) Notice: Subject to any disclaimer, the term of this patent is extended or adjusted under 35 U.S.C. 154(b) by 0 days.

(21) Appl. No.: 11/304,111

(22) Filed: Dec. 15, 2005

(51) Int. Cl.
*B63B 35/40* (2006.01)

(52) U.S. Cl. ..... 114/259; 114/263

(58) Field of Classification Search ..... 114/259, 114/263; D12/316
See application file for complete search history.

(56) References Cited

U.S. PATENT DOCUMENTS 3,339,217 A * 9/1967 Gudmundson ..... 114/344
D398,576 S * 9/1998 Hillman et al. ..... D12/316
5,875,727 A * 3/1999 Elson et al. ..... 114/259
6,135,047 A * 10/2000 Miller ..... 114/343
6,431,106 B1 * 8/2002 Eva et al. ..... 114/263
D506,431 S * 6/2005 Elson ..... D12/316

* cited by examiner

*Primary Examiner*—Stephen Avila
(74) *Attorney, Agent, or Firm*—Donald W. Meeker

(57) ABSTRACT

A pair of spaced parallel female slots or grooves located on the bottom of a watercraft float enable the pair of spaced parallel male ribs or rails located on top of a float to fit within the slots or grooves on the bottom of another float when the watercraft floats are interconnected or stacked on top of each other.

10 Claims, 3 Drawing Sheets

STACKABLE WATERCRAFT FLOAT SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to floats for watercraft and in particular to a stackable watercraft float system wherein each watercraft float has a pair of spaced parallel indented slots on a bottom of the float to receive and mate with two protruding spaced parallel tracks on the top of each float so that a number of the floats can be stacked together for transportation and storage in a stack which takes up less vertical space than floats with no bottom slots to receive the top tracks.

2. Description of Related Art Including Information Disclosed Under 37 CFR 1.97 and 1.98

Watercraft floats are well known. Common features of a dry dock watercraft float consist of a durable plastic shell outside and air or foam filled inside. The watercraft is driven onto the float with guidance of the floats rails, which are generally located on top of the float. The float rails consumes dead space when trying to store and transport units. There is a problem with a high cost of storage and transportation of watercraft floats. Prior art devices do not provide nested designs or features incorporated into watercraft floats.

Prior art watercraft float patents include U.S. Pat. No. 5,875,727 for a Lift For a Personal Watercraft; U.S. Pat. No. 5,941,660 for a Modular Watercraft Support Structure; U.S. Pat. No. 5,795,098 for a Modular watercraft support structure; No. D398576 for a Personal Watercraft Dock, and No. D506431 for a Lift For a Personal Watercraft.

What is needed is watercraft floats which nest together when stacked requiring less space during transportation and storage.

BRIEF SUMMARY OF THE INVENTION

An object of the present invention is to nest two or more watercraft floats snugly together in a stack to reduce space for transporting or storing units.

Another object of the present invention is to reduce the cost of storage and transportation of watercraft floats by reducing the space required to store or transport the floats.

Yet another object of the present invention is to accommodate a variety of watercraft types on the float.

Still another object of the present invention is to make the watercraft float become more competitive in pricing in the market place.

In brief, the present invention comprises a pair of spaced parallel female slots or grooves located on the bottom of a watercraft float that enable the pair of spaced parallel male ribs or rails or tracks located on top of a float to fit within the slots or grooves on the bottom of another float when the watercraft floats are interconnected or stacked on top of each other. This greatly reduces the height of a stacked array of the watercraft floats, which saves space and allows for the inclusion of more floats in a given space during transportation or storage of the floats.

The purpose of the device is to provide a secure way of stacking watercraft floats so as to reduce the space required for storage or transportation of the floats, thereby lowering the cost of storage or transportation of the floats and helping to make the cost of the floats more competitive in the marketplace.

An advantage of the present invention is that it greatly reduces the cost of storage and transportation of the watercraft float units. A related advantage of the present invention is that retail customers and wholesalers who buy and store these products will benefit by a reduction in cost of shipping and storage of these items and the reduction of overhead will help the watercraft float of the present invention become more competitive in pricing in the market place.

A further advantage of the present invention is that it provides a unique structural design.

One more advantage of the present invention is that it can accommodate a variety of watercraft types to drive onto the floats which serve as floating docks for the watercraft.

Yet another advantage of the present invention is that the interlocking rails and slots provide a more stable stacked array.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
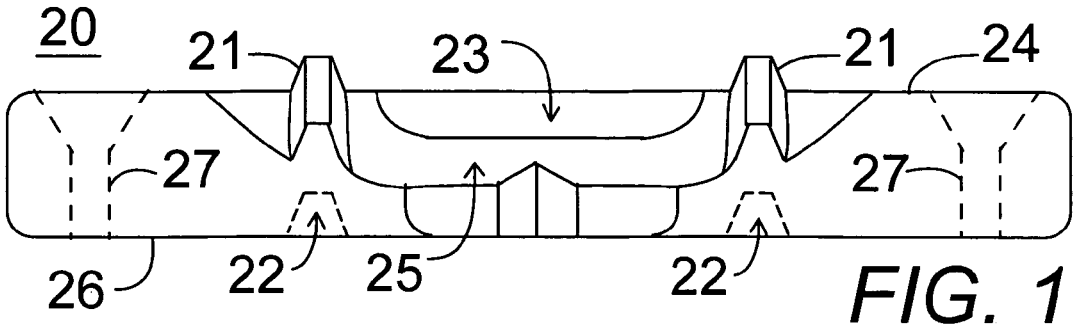
FIG. 1 is a front elevational view of the watercraft float of the present invention showing the ramp on a front end.

In FIGS. 1–6, a stackable watercraft float 20 comprises bottom slots 22 which receive the top protruding guide ribs or rails or tracks 21 of another float in the slots 22 when a number of the watercraft floats are stacked for storage or transportation, thus allowing the flat bottom surfaces 26 to contact the flat top surfaces 24 of adjacent watercraft floats.

The watercraft float 20 comprises a buoyant body having a flat top surface 24 portion around the edges and a flat bottom surface 26 with only two indented grooves 22, a front end 10, a back end 12, and two sides 11 and 13.

Figure 2:
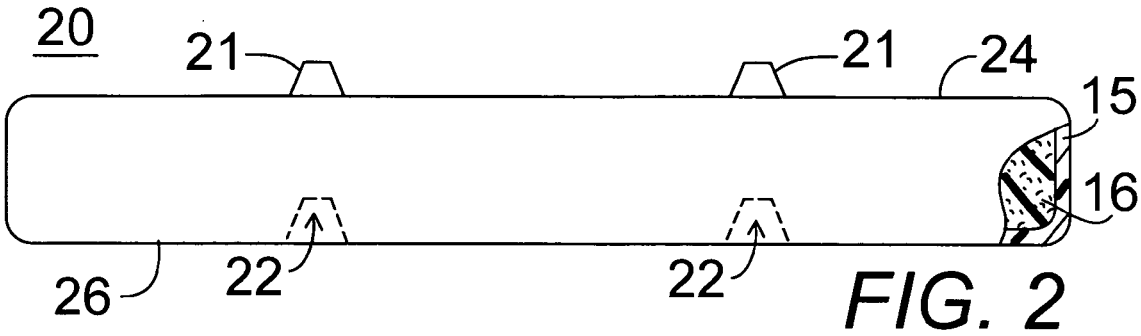
FIG. 2 is a rear elevational view of the watercraft float of FIG. 1 showing the back end.
Figure 3:
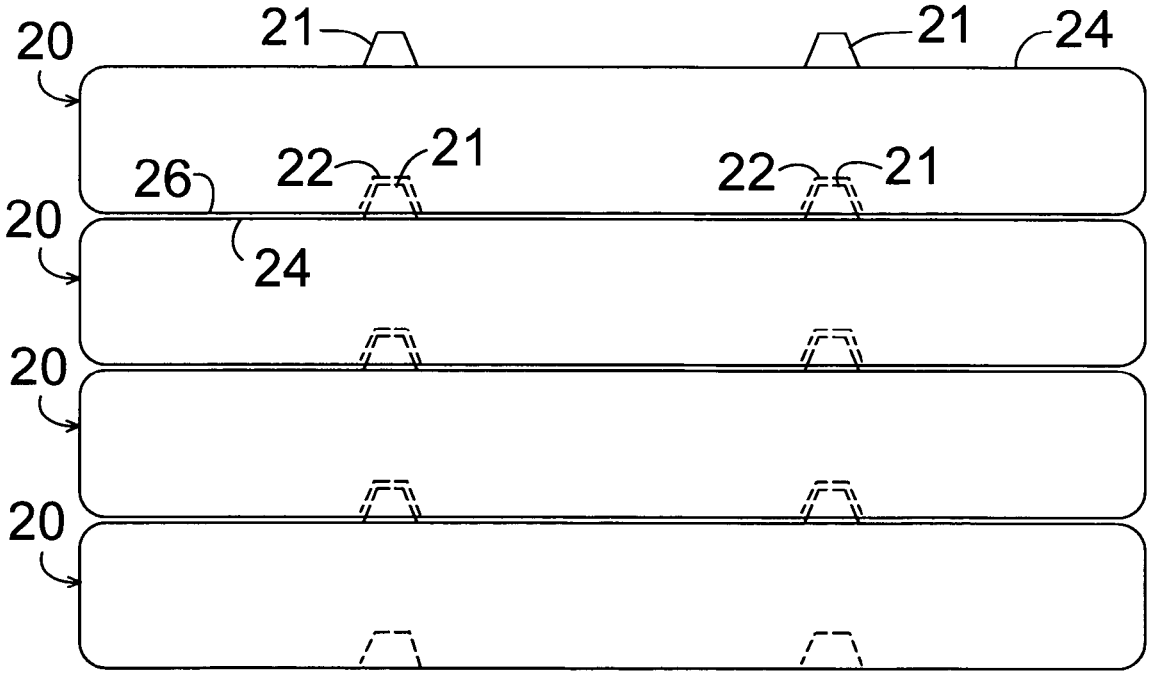
FIG. 3 is a rear elevational view of a number of he watercraft floats of FIG. 1 stacked for storage or transporting with the top tracks inserted in the bottom slots.
Figure 4:
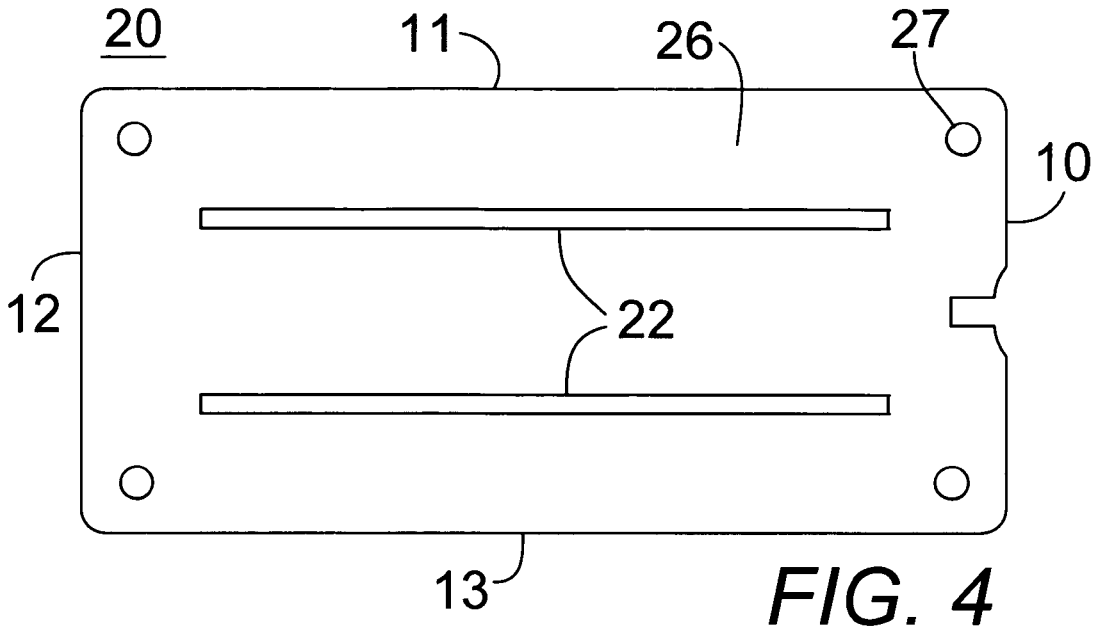
FIG. 4 is a bottom plan view of the watercraft float of FIG. 1 showing the bottom surface comprising a flat bottom surface with a pair of spaced parallel indented slots and four corner holes.

In FIG. 2, a preferred embodiment of the watercraft float 20 has an outer shell 15 made of a rigid material resistant to damage from watercraft using the watercraft float, and an inner chamber 16 inside the shell that contains a buoyant material. Preferably, the outer shell 15 is molded from low-density polyethylene and has a wall thickness of the 3/16 inch, and the inner chamber 16 is filled with expanded polystyrene.

Figure 5:
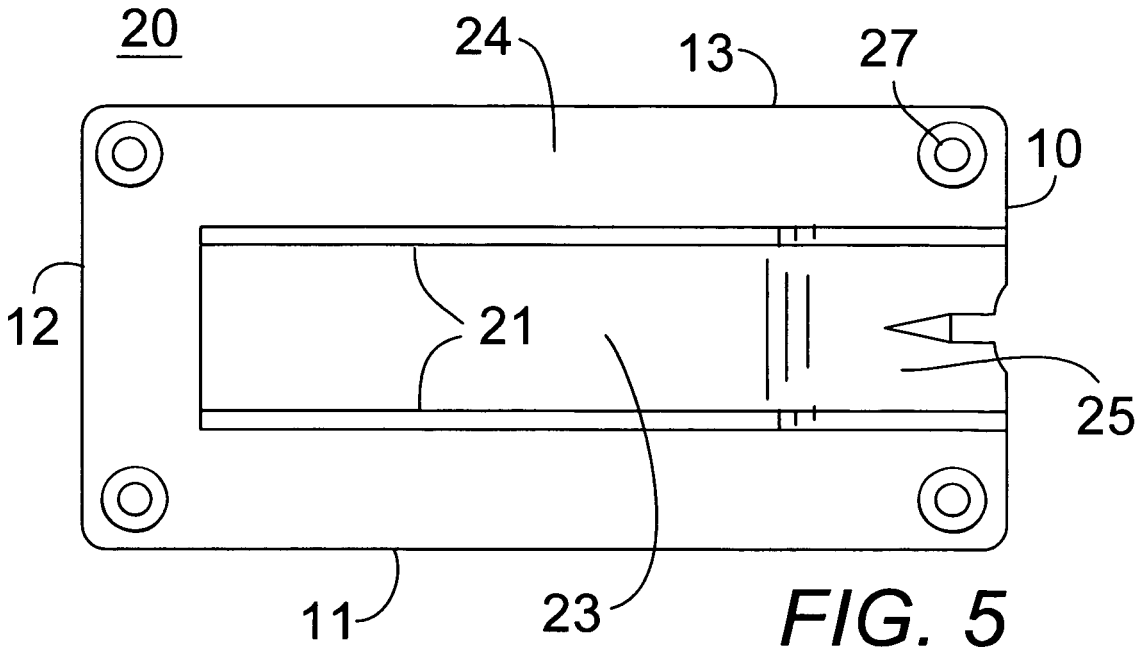
FIG. 5 is a top plan view of the watercraft float of FIG. 1 showing the top surface comprising a flat top surface with a pair of spaced parallel protruding tracks, a front ramp, and four corner holes.
Figure 6:
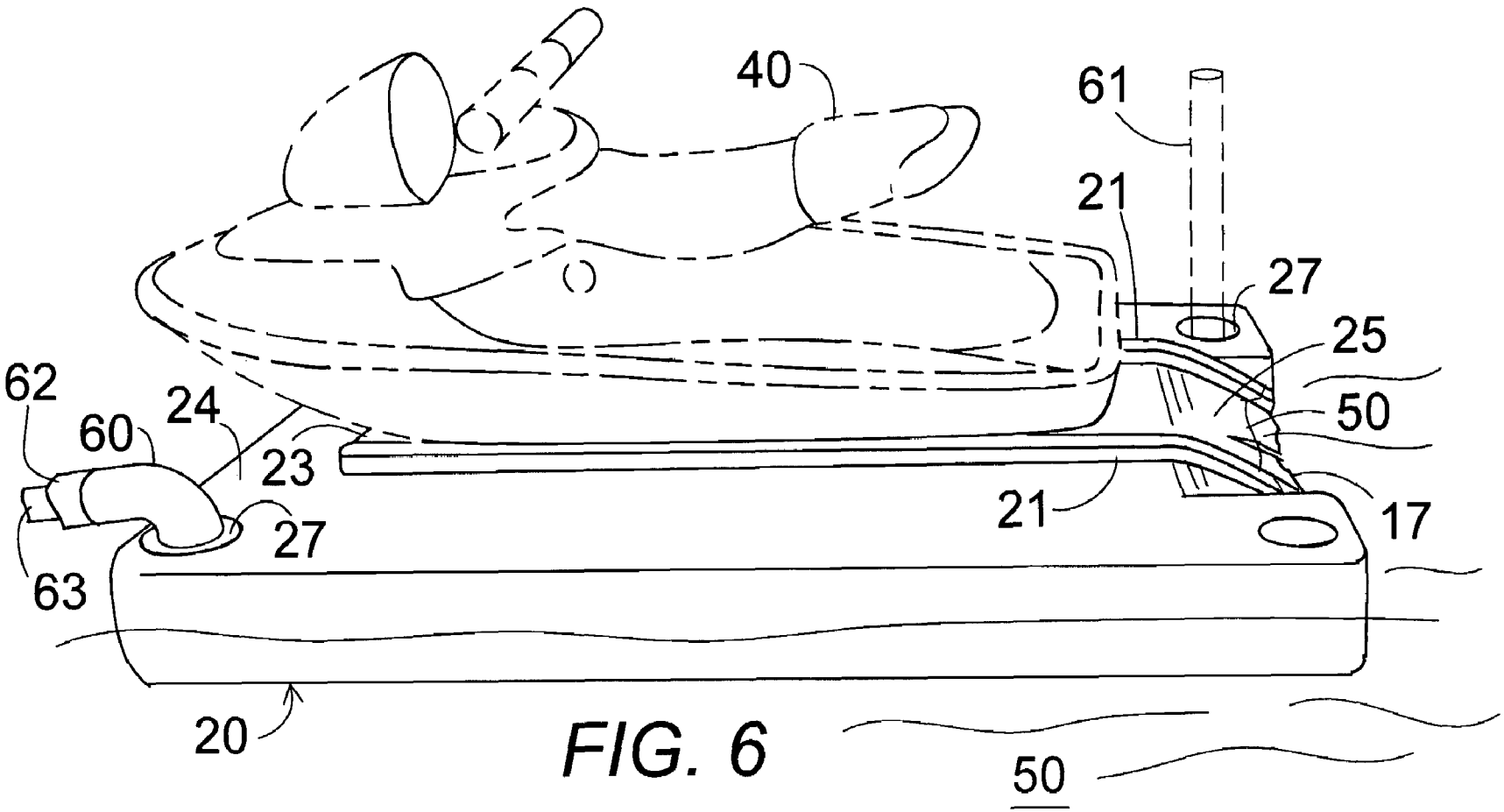
FIG. 6 is a perspective view of the watercraft float of FIG. 1 in a body of water showing a personal watercraft resting on the watercraft float.

In FIGS. 1, 5, and 6, the top of the watercraft float has a flat top surface 24 adjacent to the two sides 11 and 13, and the back end 12. The top of the watercraft float has a pair of protruding spaced parallel ribs or rails or tracks 21 along a portion of the length of the watercraft float and a recessed boat receiving trough 23 and a sloping boat ramp 25 between the pair of protruding spaced parallel tracks 21. The sloping boat ramp 25 extends downward from the boat receiving trough 23 to a low boat receiving edge 17, as shown in FIG. 6, positioned below the level of the water 50 at the front end 10 of the watercraft float, while the float is in the water 50. This sloping boat ramp receives a watercraft 40, as shown in FIG. 6, that is driven from a body of water surrounding the float up the ramp and into the recessed boat receiving trough 23 with the pair of protruding spaced parallel tracks 21 acting as guides for directing the watercraft into the boat receiving trough.

In FIGS. 1 through 4, the bottom surface of the float has a flat bottom surface 26 with a pair of spaced parallel indented slots 22 in the bottom of the watercraft float directly below the pair of protruding spaced parallel tracks 21 on the top surface. The pair of spaced parallel indented slots 22 is configured to receive and mate with a pair of protruding spaced parallel tracks 21 from another similar watercraft float positioned directly below the watercraft float in a stacked array, allowing the flat bottom surface 26 of the upper watercraft float to contact the flat upper surface 24 of the lower watercraft float. In this way, a number of the watercraft floats can be stacked together for transportation and storage in a stacked array with the tracks and slots interlocking to secure the stacked array, thereby taking up less vertical space than watercraft floats with no bottom slots to receive the top tracks.

Four openings 27, one in each of the four corners of the float, allow a securing device 60 and 61 to attach the float to a stationary mooring. In one embodiment, the securing device is a pair of pipes attached to a floating dock, that each have a 90-degree pipe elbow 60 (preferably hot dipped galvanized pipes 63, which will not rust, which may have a polyvinyl chloride pipe sleeve 62 over each pipe and elbow to prevent the galvanized surface from scraping off) inserted into at least two of the four openings 27 in the corners of the float to secure the float for receiving a watercraft driven onto the watercraft float. In another embodiment, the means for attaching the watercraft float 20 to an underwater ground surface is a pair of pipes 61 (preferably hot dipped galvanized pipes, which will not rust, which may have a polyvinyl chloride pipe sleeve over each pipe and elbow to prevent the galvanized surface from scraping off) inserted through at least two of the four openings 27 of the float with a sliding fit to secure the float for receiving a watercraft driven onto the watercraft float. The pipes 61 extend down into the underwater ground surface and extend up above the top surface of the watercraft float so that the float can move up and down the pipes with the changing water level, while remaining secured to the pipes.

It is understood that the preceding description is given merely by way of illustration and not in limitation of the invention and that various modifications may be made thereto without departing from the spirit of the invention as claimed.

What is claimed is:

1. A stackable watercraft float system comprising:

a watercraft float comprising a buoyant body having a top surface and a bottom surface, a front end, a back end and two sides;

the top surface comprising a flat top surface adjacent to the two sides and the back end of the watercraft float having a pair of protruding spaced parallel tracks along a portion of the length of the watercraft float and a recessed boat receiving trough and a sloping boat ramp between the pair of protruding spaced parallel tracks, the sloping boat ramp extending downwardly from the boat receiving trough to a low boat receiving edge positioned below a level of the water at a front end of the watercraft float, with the watercraft float in a body of water, to receive a watercraft driven from a body of water surrounding the watercraft float up the ramp into the recessed boat receiving trough with the pair of protruding spaced parallel tracks acting as guides for directing the watercraft into the boat receiving trough;

the bottom surface comprising a flat bottom surface with a pair of spaced parallel indented slots in the bottom of the watercraft float directly below the pair of protruding spaced parallel tracks on the top surface, the pair of spaced parallel indented slots configured to receive and mate with a pair of protruding spaced parallel tracks from another similar watercraft float positioned directly below the watercraft float in a stacked array comprising an upper watercraft float and a lower watercraft float with a flat top surface of the lower watercraft float contacting the flat bottom surface of the upper watercraft float so that a number of the watercraft floats can be stacked together for transportation and storage in a stacked array with the tracks and slots interlocking to secure the stacked array which takes up less vertical space than watercraft floats with no bottom slots to receive the top tracks; and a means for securing the watercraft float to a stationary mooring.

2. The system of claim 1 wherein the means for securing the watercraft float to a stationary mooring comprises four openings one at each of four corners of the watercraft float, so that a securing device in at least two of the four openings attaches the watercraft float to the stationary mooring.

3. The system of claim 2 wherein the means for securing the watercraft float to a floating dock comprises a pair of pipes attached to the floating dock and the pair of pipes each having a 90-degree pipe elbow inserted in one of at least two of the four openings of the watercraft float to stabilize the watercraft float for launching the watercraft onto the watercraft float.

4. The system of claim 2 wherein the means for securing the watercraft float to an underwater ground surface below the watercraft float comprises a pair of pipes each inserted through one of at least two of the four openings of the watercraft with a sliding fit, the pipes extending up above the watercraft float and extending down into the ground surface below the watercraft float to stabilize the watercraft float for receiving a watercraft driven onto the watercraft float and so that the watercraft float is free to move up and down relative to the pipes with water movement while being secured to the pipes.

5. The system of claim 2 further comprising a series of plugs to fill in each of the four openings not in use for securing the watercraft float.

6. The system of claim 1 wherein the means for securing the watercraft float to a stationary mooring comprises at least two hot dipped galvanized pipes inserted into at least two of the four openings of the watercraft float with the pipe connected to the stationary mooring.

7. The system of claim 6 wherein a polyvinyl chloride pipe sleeve fits over each of the pipes to prevent a galvanized surface on each of the pipes from scraping off in use.

8. The system of claim 1 wherein the watercraft float comprises an outer shell of a rigid material resistant to damage from watercraft using the watercraft float and an inner chamber inside the shell contains a buoyant material.

9. The system of claim 8 wherein the watercraft float outer shell is molded from low-density polyethylene and the inner chamber is filled with expanded polystyrene.

10. The system of claim 8 wherein the outer shell has a wall thickness of the 3/16 inch.

* * * * *